US010894694B2

(12) United States Patent
Mabry, Jr. et al.

(10) Patent No.: US 10,894,694 B2
(45) Date of Patent: Jan. 19, 2021

(54) BODY MOUNT AND RETRACTOR FOR SUPPORT OF HANDS FREE PORTABLE POWER, VIDEO ENHANCEMENT, AND DATA TRANSFER BETWEEN WIRELESS DEVICES

(71) Applicants: James A. Mabry, Jr., Anthem, AZ (US); Danny J. Kleitsch, Scottsdale, AZ (US)

(72) Inventors: James A. Mabry, Jr., Anthem, AZ (US); Danny J. Kleitsch, Scottsdale, AZ (US)

(73) Assignee: All Clear Fire Systems, LLC, Phoenix, AZ (US)

( * ) Notice: Subject to any disclaimer, the term of this patent is extended or adjusted under 35 U.S.C. 154(b) by 305 days.

(21) Appl. No.: 15/941,617

(22) Filed: Mar. 30, 2018

(65) Prior Publication Data

US 2018/0282107 A1 Oct. 4, 2018

Related U.S. Application Data

(60) Provisional application No. 62/479,950, filed on Mar. 31, 2017.

(51) Int. Cl.

| | |
|---|---|
| ***B65H 75/40*** | (2006.01) |
| ***B65H 75/44*** | (2006.01) |
| ***A45F 5/00*** | (2006.01) |
| ***B65H 75/48*** | (2006.01) |

(52) U.S. Cl.

CPC ..... *B65H 75/406* (2013.01); *A45F 5/004* (2013.01); *B65H 75/4402* (2013.01); *B65H 75/446* (2013.01); *B65H 75/48* (2013.01); *A45F 2005/006* (2013.01)

(58) Field of Classification Search

CPC .... B65H 75/406; B65H 75/446; B65H 75/48; B65H 75/4402; A45F 5/004; A45F 2005/006

See application file for complete search history.

(56) References Cited

U.S. PATENT DOCUMENTS

| | | | | |
|---|---|---|---|---|
| 2,630,979 | A | 3/1953 | Uerling | |
| 2,691,492 | A | 10/1954 | Lang | |
| 4,155,168 | A | 5/1979 | DuBois | |
| 4,200,983 | A | 5/1980 | West et al. | |
| 5,431,404 | A | 7/1995 | Kotecki | |
| 5,513,785 | A * | 5/1996 | Campagna, Jr. ..... | F41C 33/04 224/162 |
| 6,502,727 | B1 | 1/2003 | Kecoteau | |
| 6,616,080 | B1 * | 9/2003 | Edwards ..... | A45C 7/0045 191/12.2 R |

(Continued)

FOREIGN PATENT DOCUMENTS

| | | |
|---|---|---|
| GB | 191111333 | 4/1912 |
| WO | 0100055 | 1/2001 |

*Primary Examiner* — William A. Rivera
(74) *Attorney, Agent, or Firm* — Venjuris, P.C.

(57) ABSTRACT

This invention is embodied in a body mount and retractable lanyard that enables its user to pull and retract a device perpendicularly from the face of a spool connected to a user. In this way, the body mount enable its user to access hands-free portable power, video and data transfer for public safety personnel and others operating in extreme and challenging environmental conditions.

2 Claims, 16 Drawing Sheets

(56) References Cited

U.S. PATENT DOCUMENTS

| | | | | |
|---|---|---|---|---|
| 6,626,391 | B2 * | 9/2003 | Kretsch | A01K 3/00 242/395.1 |
| 7,369,739 | B2 * | 5/2008 | Kline | B65H 75/44 385/135 |
| 8,757,532 | B2 | 6/2014 | Votel | |
| 9,745,168 | B1 * | 8/2017 | Hinojosa | B65H 75/44 |
| 9,908,742 | B2 * | 3/2018 | Mertesdorf | B65H 75/4402 |
| 2017/0299835 | A1 * | 10/2017 | Alford | G02B 6/4459 |
| 2019/0292006 | A1 * | 9/2019 | Alford | B65H 75/4449 |

* cited by examiner

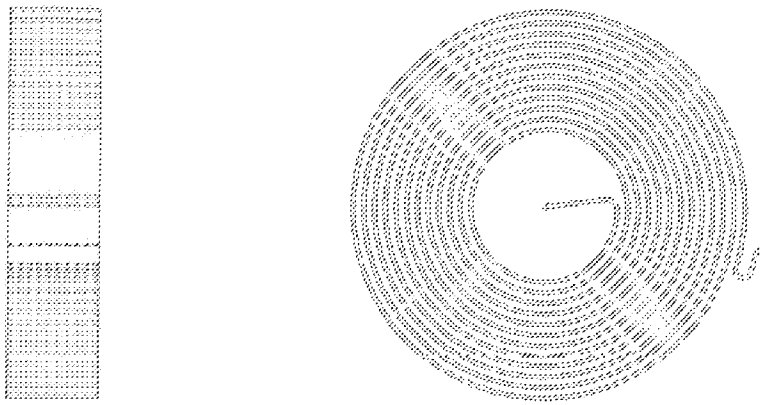
Fig. 25
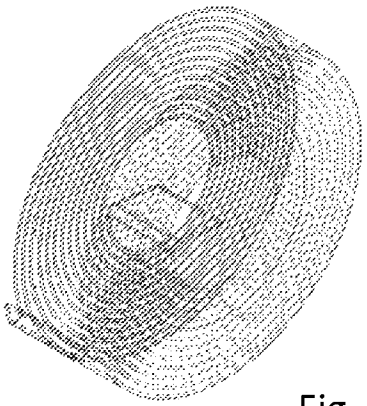
Fig. 27
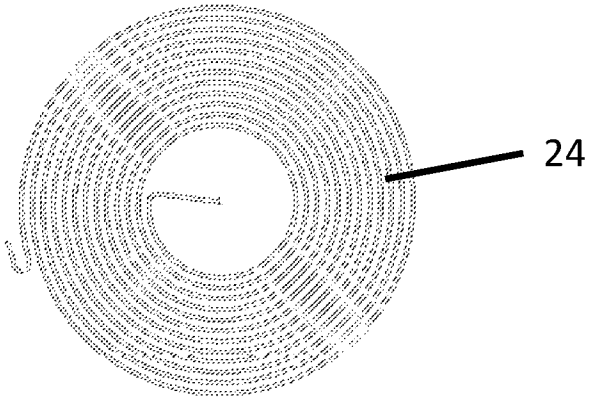
Fig. 24
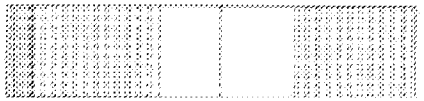
Fig. 23
Fig. 26

BODY MOUNT AND RETRACTOR FOR SUPPORT OF HANDS FREE PORTABLE POWER, VIDEO ENHANCEMENT, AND DATA TRANSFER BETWEEN WIRELESS DEVICES

CROSS-REFERENCE TO RELATED APPLICATION

This application claims benefit of U.S. Provisional Application No. 62/479,950 filed Mar. 31, 2017.

FIELD OF INVENTION

This invention generally relates to a body mount and retractor for use in public safety applications (i.e. firefighting, law enforcement, and border protection), and more specifically to a body mount and retractor for hands-free portable power, video and data transfer.

BACKGROUND

Those who work in the field of public safety (i.e. firefighting, law enforcement, and border protection) are asked to fill many roles and operate in diverse emergent scenes. These scenes include law enforcement operations, structural firefighting, wild land firefighting, vehicular accidents, technical rescues, hazardous material exposures, and emergency medical incidents. All of these incident scenes present unique and different challenges.

One thing that is common to all of these incident scenes is the need to communicate data wirelessly—and many times hands-free—between team members. The types of data needed to be wirelessly communicated include voice data, video data, and thermal imaging data. For example, border agents need small, hands-free devices that attach to protective vests to provide lighting, thermal intelligence, video, and radiation/atmospheric monitoring capability, as well as communicate with their ATVs, overhead drones, and other team members.

The conditions under which these devices must operate can be extremely varied. For example, public safety personnel can move in many different modes: walking, running, hiking, riding on ATV/motorcycles/horses, boating, and mountain biking, to name a few. Likewise, public safety personnel operate on varied terrain, including heavy vegetation, mountains, hills, canyons and dry creeks, rivers, streams found in desert, shorelines, open prairies, semi-arid, and heavily forested environments. In addition, atmospheric challenges can include fog, blowing salt/dust, extreme haze or other naturally occurring or adversary-produced vision interferences such as smoke and other irritants. Under many of the above conditions, it will be critical for public safety personnel not only to be able to operate devices hands-free, but also have those devices tethered to their bodies so that the devices don't fall or get damaged during an operation.

In addition, the temperatures under which these devices must operate can be extreme, too. For example, temperatures at the nozzle end of a hand line in a fire suppression operation (i.e., the "tip of the spear") can exceed 1,000° F. Such extreme temperatures can lead to failure by ordinary devices. Fire fighters operating in forward positions have the best vantage point to quickly and efficiently neutralize the threat, but are severely limited because of the nature of the tools with which they are currently equipped. Current prior art tools and techniques are not sufficient for the demands of the job.

In light of these extreme conditions, devices must be operated—at least some of the time—in hands free mode. One way to enable hands-free use of devices is to connect them to a retractable lanyard (or tether). The other end of the retractable lanyard is then attached to the user. Retractable lanyards are known in the art. However, prior art lanyards are primarily configured to pull out radially from the spool 28 (a "radial-pull lanyard"). Radial-pull lanyards do not work very well when they are attached to shoulder strap or to the front of a user's vest. When a retractable lanyard is connected to a user in the upper chest/shoulder region, the lanyard should be preferably pulled perpendicularly away from the face of the spool 28 (i.e., perpendicular to the axis of spool rotation). None of the prior art devices permit a user to pull and retract a device perpendicularly from the face of the spool 28 in a way that would work under the conditions noted above.

Therefore, it would be desirable to provide a body mount and retractable lanyard that would allow its user to pull and retract a device perpendicularly from the face of a spool 28 mounted to a vest in a way that would work under the conditions noted above. In this way, the body mount and retractable lanyard enable a hands-free device to be used by public safety personnel.

SUMMARY

The present invention is incorporated in a body mount device illustrated in the accompanying schematics. The invention presented in this specification provides an original solution to enable hands-free portable power, video and data transfer for public safety personnel and others operating in extreme environmental conditions.

Broadly, the body mount 10 is a device for retractably tethering a hand-held device to a user. An example of a hand-held device that might be tethered is a phone, a two-way radio, a video capture device, a thermal imaging camera, or other similar device. The body mount 10 is connected to the user by any number of ways known in the art. The body mount 10 has a retractable tether that connects to the hand-held device.

The body mount 10 has at least two modes. In the first mode, the hand-held device is in a retracted (or seated) position. The first mode allows the user to operate the device hands-free. In the second mode, the user pulls the device away from the body mount to operate the device in-hand (the extended position).

One important aspect of the invention is the orientation of the tether inside the body mount. As shown in FIGS. 33, 34, and 35 shape of the tether inside the body mount resembles a conical helix or nautilus. Because the hand-held device is being extended (pulled) perpendicular to the rotation of the spool 28, it is important that the tether is moved from the perimeter of the spool 28 to the center of the rotational axis of the spool 28 before being pulled in parallel to the spool's axis of rotation. Said another way, the tether initially comes off the spool radially (e.g., horizontally), but must be ultimately be redirected along the spool's axis of rotation (e.g., vertically). This is accomplished by an interior sheath through which the tether travels. Using the tether sheath to move the tether from the perimeter of the spool 28 to the center of the spool 28 before changing the direction of the tether 90° (i.e., from horizontal to vertical) reduces the friction between the tether and the sheath and reduces the rotational torque applied to the body mount 10, both of which allow the hand-held device to the pulled out and retracted smoothly.

The tether sheath 60 is preferably formed by creating a bottom channel 46 on the top side of a first piece and a top channel 48 in the bottom side of a second piece and then holding the two pieces together to create a sheath formed by the top channel 48 and the bottom channel 46. An example of this is shown by comparing the wire guide back 36 shown in FIGS. 28-32 with the inner wire guide 44 shown in FIGS. 45-49. A segment of the bottom channel 46 shown in FIG. 28 mates with the top channel 48 shown in FIG. 45.

The preferred embodiment of the tether sheath 60 is created by fitting four pieces together: the wire guide back 36, the center wire guide 42, the inner wire guide 44, and the outer housing 56. The entire bottom channel 46 is located on the top face of the wire guide back 36. And when the inner wire guide 44, the center wire guide 42 and the outer housing 56 are fit together as shown in FIG. 2, the four pieces form a tether sheath 60 shaped to hold the tether as shown in FIGS. 33-35. By creating a tether sheath 60 in this shape and locating it above a conventional spring spool retraction assembly, the preferred body mount 10 enables extension and retraction of the hand-held device in a direction perpendicular to the rotation of the spool.

It is an object of this invention to enable hands-free portable power, video and data transfer for public safety personnel and others operating in extreme environmental conditions.

The features, functions, and advantages may be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein:

FIG. 23 is a top view of spool spring 24;

FIG. 24 is a side view of FIG. 23;

FIG. 25 is a bottom view of FIG. 23;

FIG. 26 is a section view of FIG. 23;

FIG. 27 is a perspective view of the spool spring 24 of FIG. 23;

DETAILED DESCRIPTION

The present invention provides a significant improvement over the prior art of body mount tethering because it enable hands-free portable power, video and data transfer for public safety personnel and others operating in extreme environmental conditions.

Figure 1:
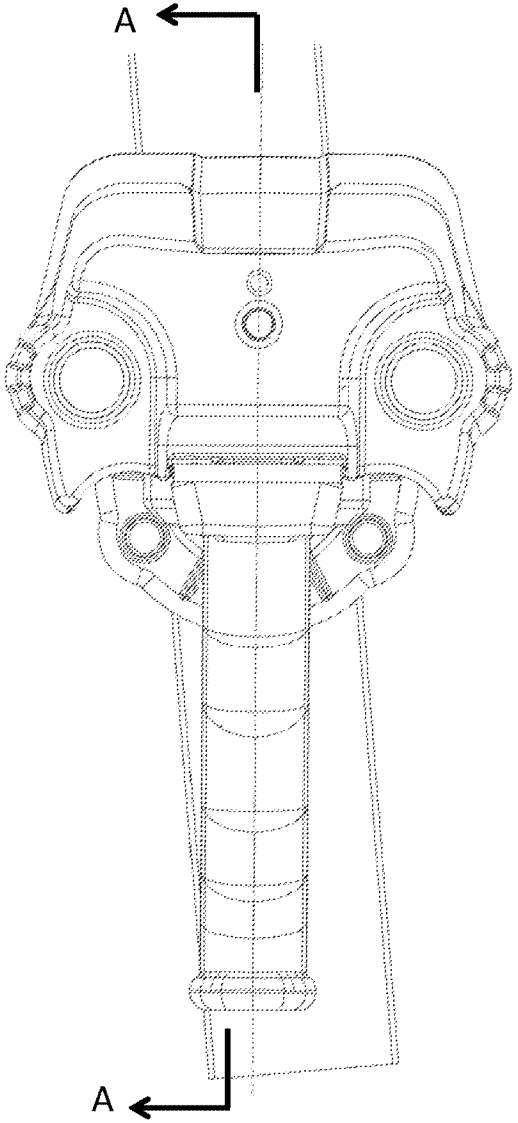
FIG. 1 is a front view of an embodiment of a thermal imaging camera connected to an embodiment of a strapped body mount 10.
Figure 61:
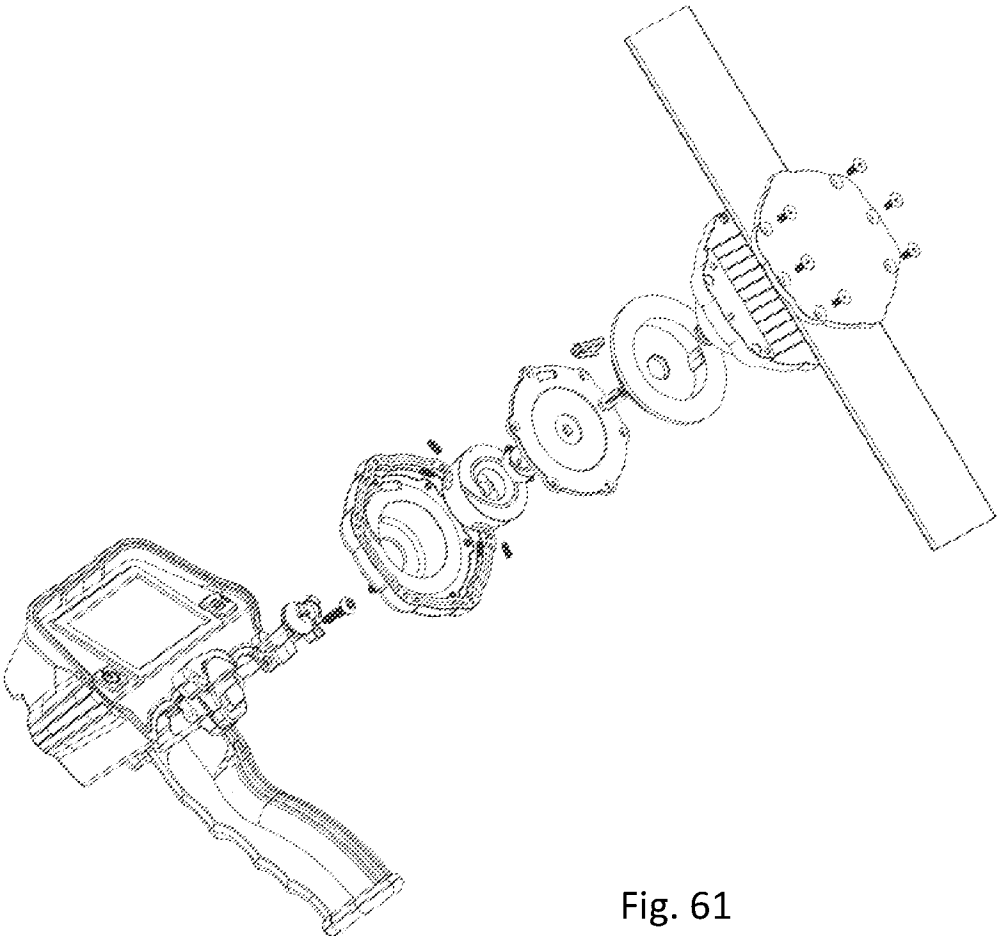
FIG. 61 is an exploded rear perspective view of FIG. 1.

As shown in FIGS. 1-61, the preferred body mount 10 is a singular unit for retractably tethering a hand-held device to its user. An example of a hand-held device that might be tethered to a user is a phone, a two-way radio, a video capture device, a thermal imaging camera, or any other similar device.

The outer shell of the preferred body mount 10 is formed by connecting the outer housing 56 to the housing bottom 20 to create a main housing using housing screws 18. A retractable tether 30 is housed within the main housing. One end of the tether 30 is connected to the main housing and the other is connected to the locking nub 58. The locking nub 58 is removably connected to the desired hand-held device by conventional spring pins or spring plunger. When a hand-held device is connected to the locking nub 58, the user can then extend the hand-held device away from the body mount 10 to use it in extended mode. Or the user can leave it in the retracted position for hands-free use in the retracted mode. The main housing is detachably connected to user preferably by a strap clamp 12 that clamps to a strap worn by the user.

The preferred main housing contains two sub-assemblies: a retractor assembly and a tether sheath assembly. The retractor assembly sits below the tether sheath assembly and functions to retract the tether 30 when the hand held device is released. The tether sheath assembly sits above of the retractor assembly and functions to re-orient the direction of the tether from a direction tangential to the outer perimeter of the spool 28 to a direction perpendicular to the rotation of the spool 28 (e.g., along the axis about which the spool 28 rotates).

Figure 62:
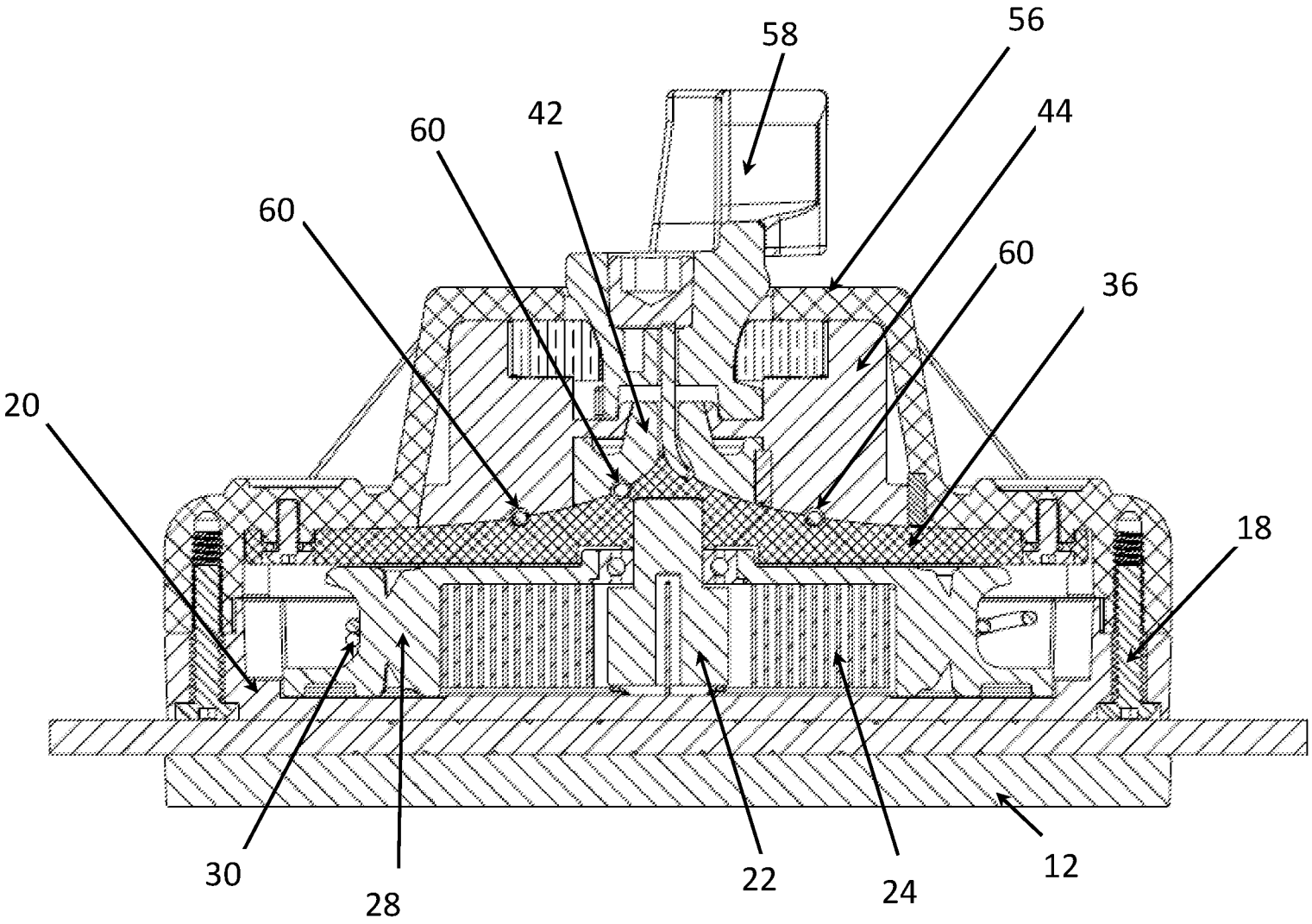
FIG. 62 is a sectional view the preferred strapped body mount 10.

The retractor assembly can employ any number of retractor assemblies known in the art. An embodiment of the preferred retractor assembly can be seen in FIG. 3. Specifically, the preferred retractor assembly comprises the following elements: the center post 22, the spool spring 24, the bearing 26, the spool 28. In the preferred embodiment, the retractor assembly is located between the underside of the wire guide back 36 and the housing bottom 20. The center post 22 can be rigidly connected to the top of the housing bottom 20. The innermost end of the spool spring 24 is inserted into a slot in the center post 22. A bearing 26 sits on top of the center post 22. The spool 28 then sits on top of the bearing 26 to allow the spool 28 to rotate more freely. The spool 28 also houses the spool spring 24, with the outermost end of the spool spring 24 connected to an interior slot of the spool 28. As shown in FIG. 62, the wire guide back 36 is connected to the bottom of the outer housing 56. The housing bottom 20 is also connected to the outer housing 56, but the combined walls of the housing bottom 20 and the outer housing 56 create space for the retractor assembly to reside.

One end of the tether is connected to the spool via a wire stop or any other connection known in the art. The primary function of the wire drop guide 38 is to transition the tether 30 from the outer perimeter of the spool 28 below the wire guide back 36 to the tether sheath assembly, which is located above the wire guide back 36.

The other end of the tether is threaded through the wire drop guide 38, which sits in an opening 60 in the wire guide back 36. The remaining length of tether is coiled around the spool 28. In operation, when the free end of the tether is extended away from the spool 28, the spool 28 rotates and tightens the spool spring 24. When the tether is released, the spool spring 24 returns to shape by un-rotating the spool 28 and retracting the end of the tether relative to the spool 28.

The tether can be made from any number of materials known in the art but is preferably a stainless steel wire rope coated with PTFE (polytetrafluoroethylene) or other slippery coating. The preferred wire rope has a diameter between 0.050" and 0.0625", such as a 9 strand (7×19) wire coated wire rope 40 inches long made by McMaster-Carr (#34235T32).

The tether sheath assembly is housed between the wire guide back 36 on the bottom and the outer housing 56 on the top. The principal purpose of the tether sheath assembly is to create an interior tube for the tether to slide through. It is preferred that the tether sheath be shaped to resemble a conical spiral, conical helix, nautilus, or other similar shape. The reason for this shape is that when the hand-held device is being extended (pulled) perpendicular to the rotation of the spool 28, it is important that the location of the tether is moved from the outside of the spool 28 to close to the center of the rotational axis of the spool 28. This is accomplished by an interior sheath 60 (or "tether sheath") through which the tether travels. Re-orienting the tether 60 to be coincident with the rotational axis of the spool 28 reduces the friction and rotational torque between the tether and the sheath when the tether is pulled along the axis of spool rotation, which correspondingly allows the hand-held device to the pulled out and retracted smoothly.

Because it is difficult to manufacture an interior tube in the shape of a conical helix, it is preferred to create the tether sheath 60 by mating at least two pieces together. One of the pieces has a top channel and the other piece has the bottom channel. When fit together, the top channel and the bottom channel form the interior tube or tether sheath 60.

Figure 3:
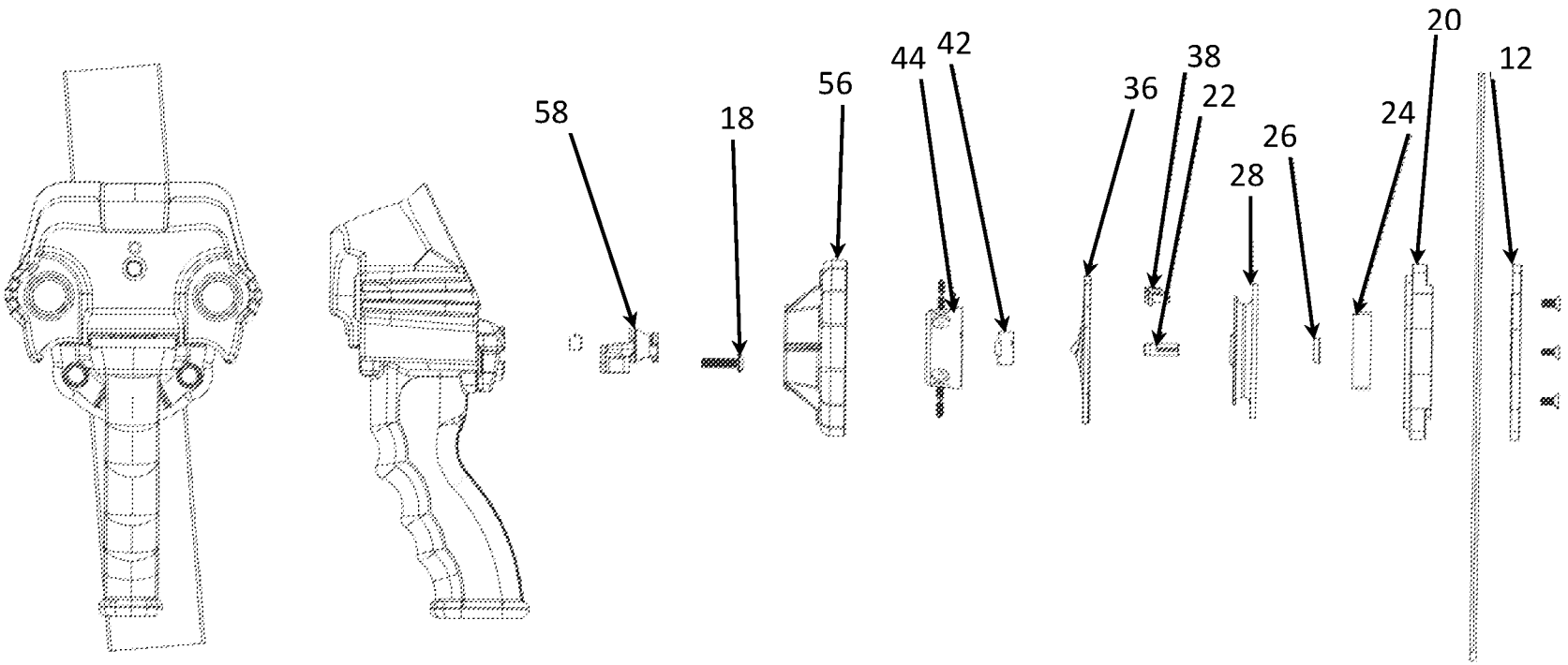
FIG. 3 is an exploded side view of FIG. 1.
Figure 6:
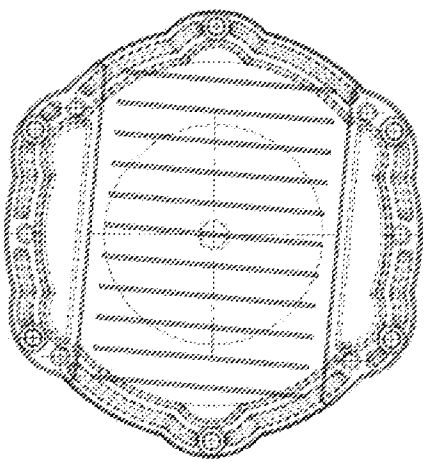
FIG. 6 is a bottom view of FIG. 1.
Figure 8:
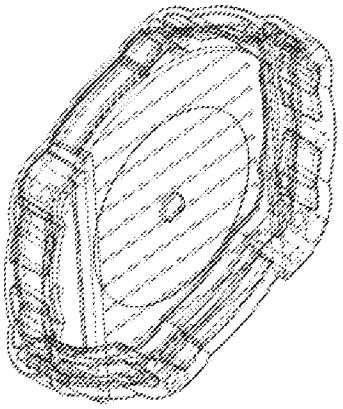
FIG. 8 is a perspective view of the housing bottom 20 of FIG. 1.
Figure 5:
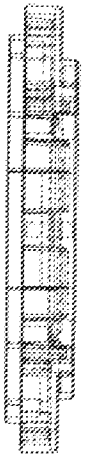
FIG. 5 is a side view of FIG. 1.
Figure 4:
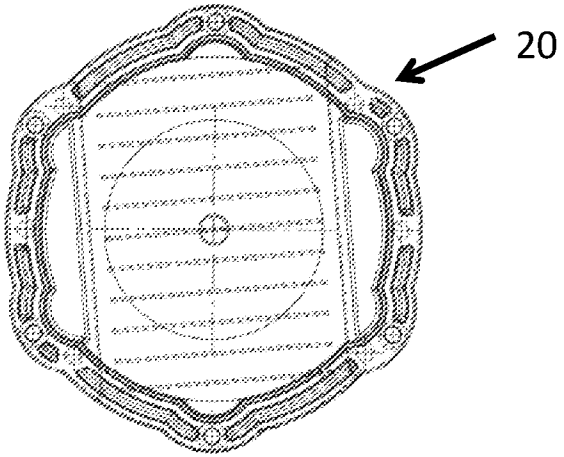
FIG. 4 is a top view of an embodiment of the housing bottom 20.
Figure 7:
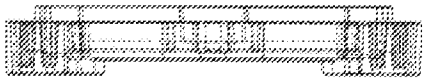
FIG. 7 is a section view of FIG. 1.
Figure 11:
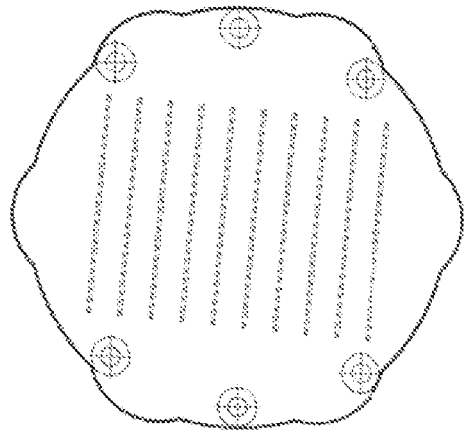
FIG. 11 is a bottom view of FIG. 9.
Figure 13:
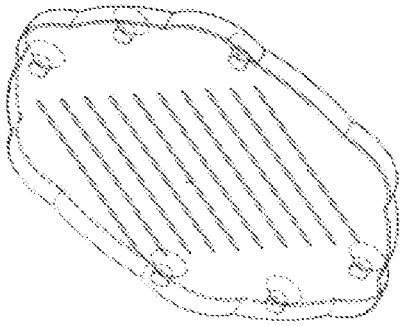
FIG. 13 is a perspective view of the strap clamp 12 of FIG. 9.
Figure 10:
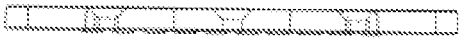
FIG. 10 is a side view of FIG. 9.
Figure 9:
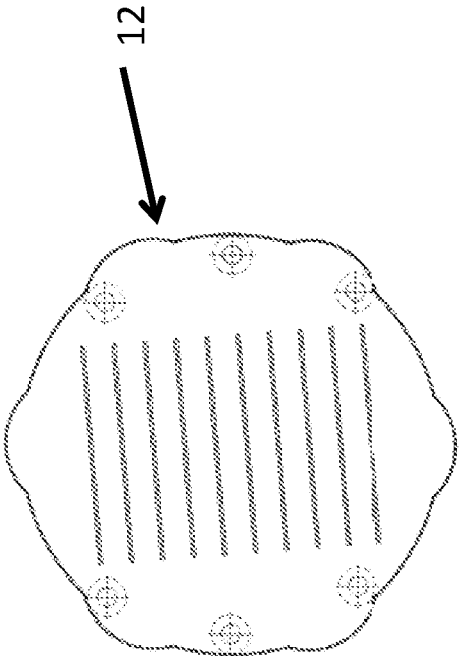
FIG. 9 is a top view of an embodiment of the strap clamp 12.
Figure 12:
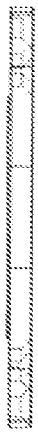
FIG. 12 is a section view of FIG. 9.
Figure 16:
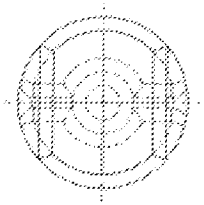
FIG. 16 is a bottom view of FIG. 14.
Figure 17:
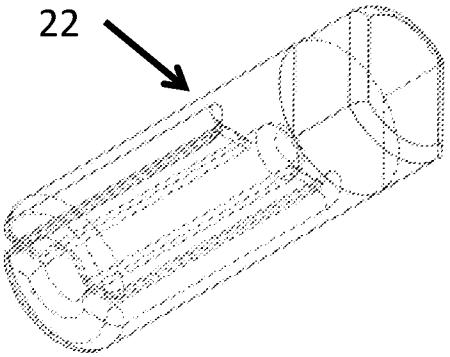
FIG. 17 is a perspective view of the center post 22 of FIG. 14.
Figure 15:
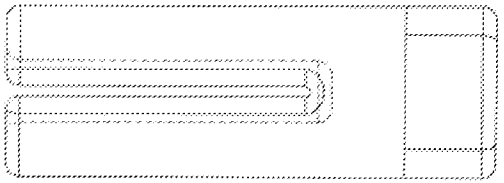
FIG. 15 is a side view of FIG. 14.
Figure 14:
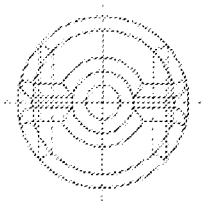
FIG. 14 is a top view of an embodiment of the center post 22.
Figure 20:
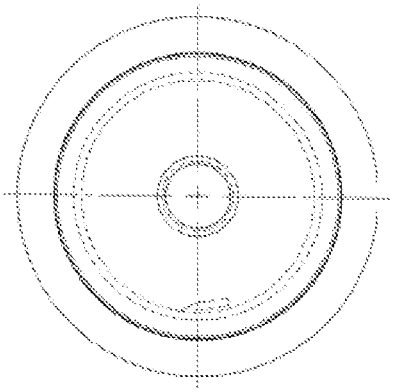
FIG. 20 is a bottom view of FIG. 18.
Figure 19:
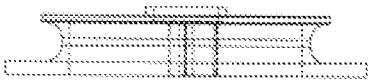
FIG. 19 is a side view of FIG. 18.
Figure 18:
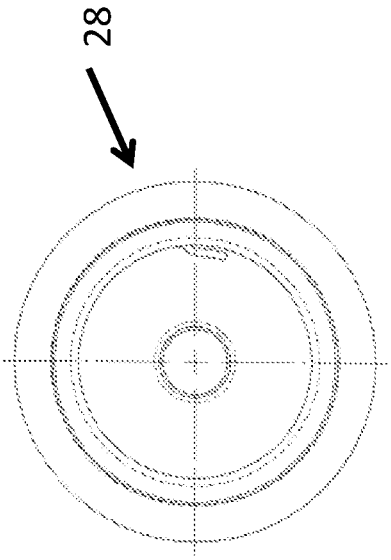
FIG. 18 is a top view of an embodiment of the spool 28.
Figure 22:
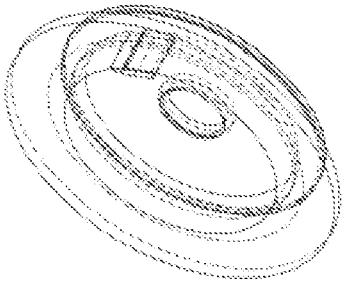
FIG. 22 is a perspective view of spool 28 of FIG. 18.
Figure 21:
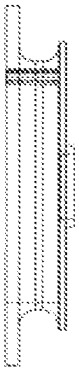
FIG. 21 is a section view of FIG. 18.
Figure 30:
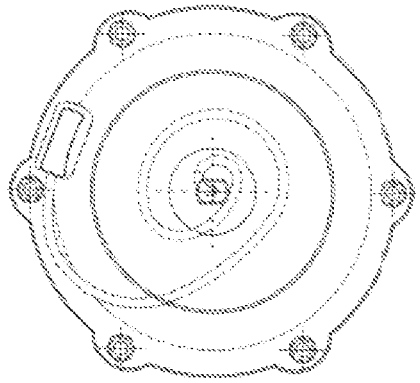
FIG. 30 is a bottom view of FIG. 28.
Figure 29:
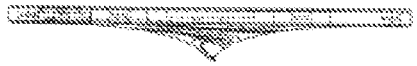
FIG. 29 is a side view of FIG. 28.
Figure 28:
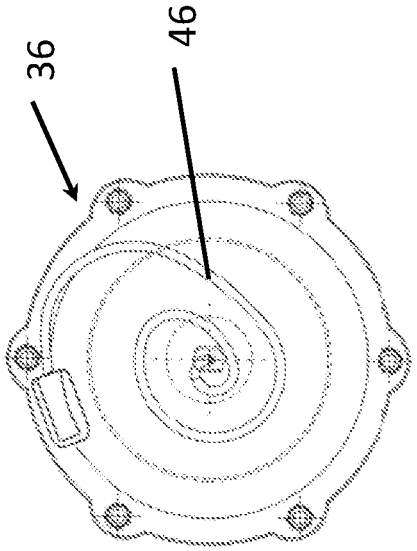
FIG. 28 is a top view of an embodiment of a wire guide back 36.
Figure 32:
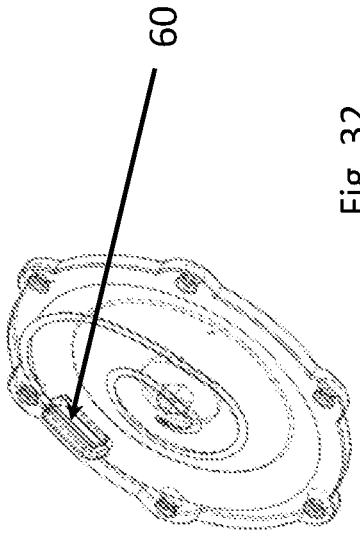
FIG. 32 is a perspective view of the wire guide back 36 of FIG. 28.
Figure 31:
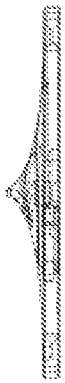
FIG. 31 is a section view of FIG. 28.

As shown in FIG. 3, the preferred tether sheath is primarily formed by the mated combination of a wire guide back 36, the center wire guide 42, the inner wire guide 44, and the outer housing 56. A bottom channel 46 is located on the top side of the wire guide back 36. As shown in FIGS. 28-32, the bottom channel 46, which is on the top side of the wire guide back 36, has a conical spiral or helical shape that rises to a point in the middle.

The top channel 48 is formed by assembling three pieces: the center wire guide 42, the inner wire guide and the outer housing 56. The center wire guide 42 fits into the bottom of the inner wire guide to form a wire guide assembly. The wire guide assembly is then inserted into the bottom of the outer housing 56. When the outer housing 56 is connected to the top of the wire guide back 36, the top side of the wire guide back 36 fits snugly against a combined bottom side of the wire guide assembly and the outer housing 56 to form the tether sheath 60. It is preferred that the top channel 48 mates with the bottom channel 46 to form the interior tube or tether sheath 60. The cross-sectional shape of the tether sheath 60 is preferably matches the cross sectional shape of the tether. The inside surface of the tether sheath 60 is preferably polished smooth.

Figure 2:
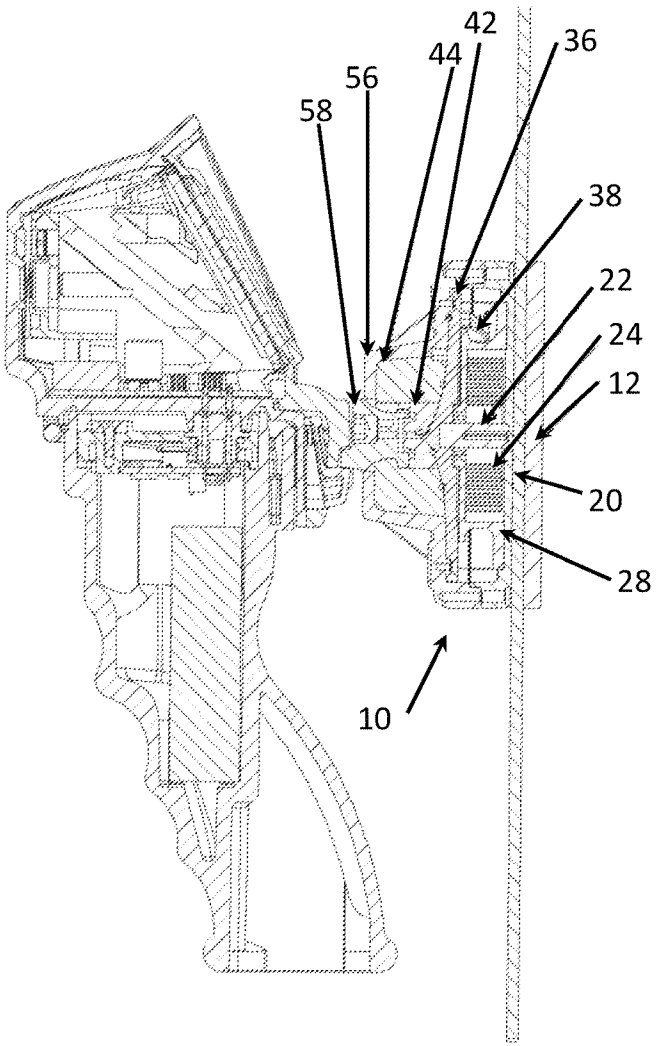
FIG. 2 is a sectional view taken along cut line A-A of FIG. 1.
Figure 34:
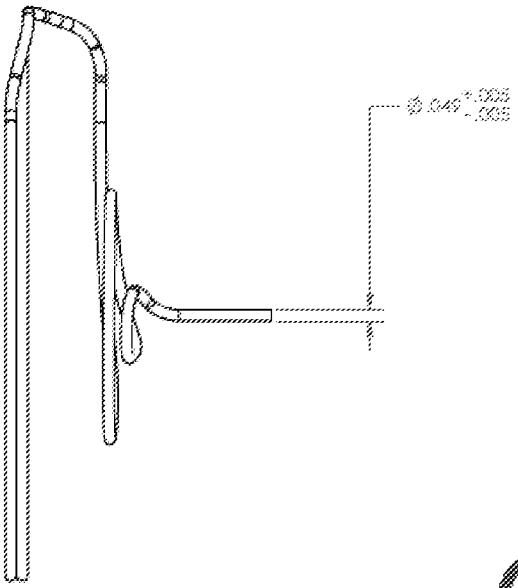
FIG. 34 is a side view of FIG. 33.
Figure 35:
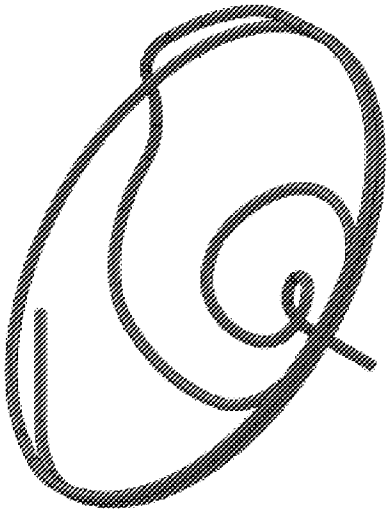
FIG. 35 perspective view of the tether 36 of FIG. 33.
Figure 33:
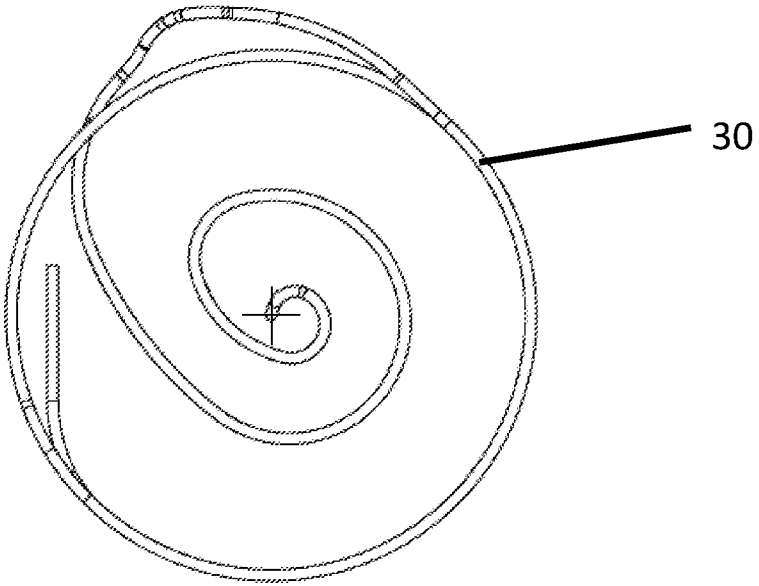
FIG. 33 is a top view of an embodiment of a tether 30.
Figure 36:
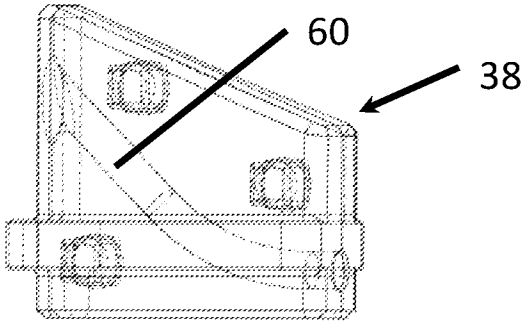
FIG. 36 is a side view of an embodiment of a wire drop guide 38.
Figure 37:
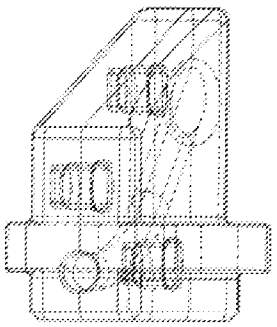
FIG. 37 is a side view of FIG. 36.
Figure 38:
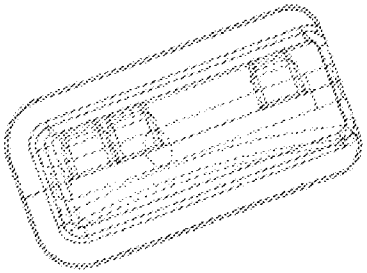
FIG. 38 is a top view of FIG. 36.
Figure 39:
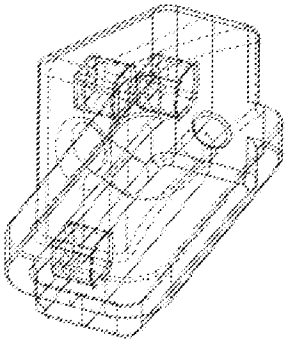
FIG. 39 is a perspective view of the wire drop guide 38 of FIG. 36.
Figure 42:
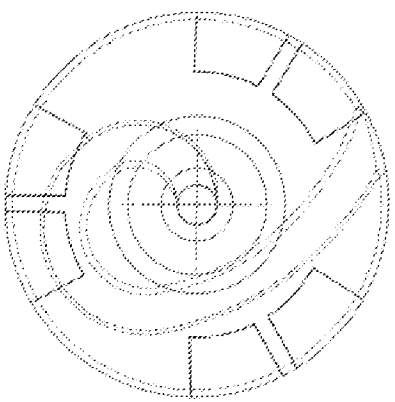
FIG. 42 is a bottom view of FIG. 40.
Figure 41:
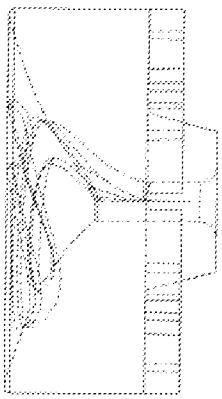
FIG. 41 is a side view of FIG. 40.
Figure 44:
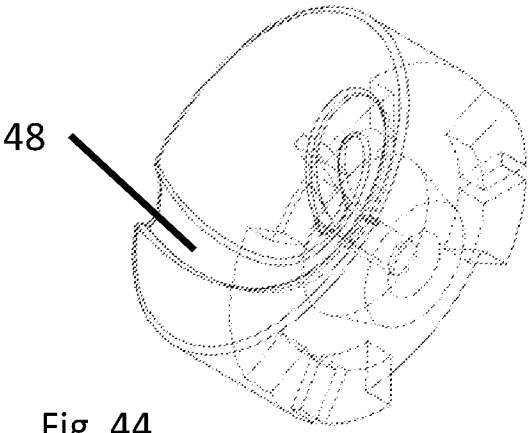
FIG. 44 is a perspective view of the center wire guide 42 of FIG. 40.
Figure 40:
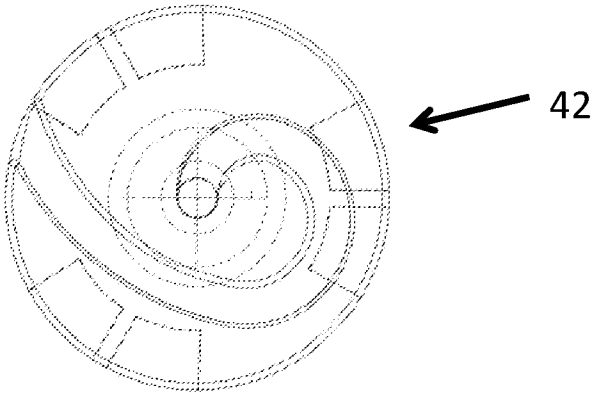
FIG. 40 is a top view of an embodiment of a center wire guide 42.
Figure 43:
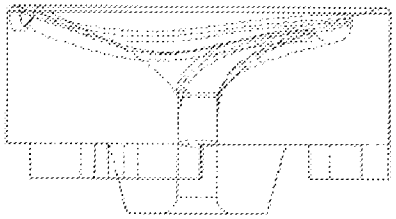
FIG. 43 is a section view of FIG. 40.
Figure 47:
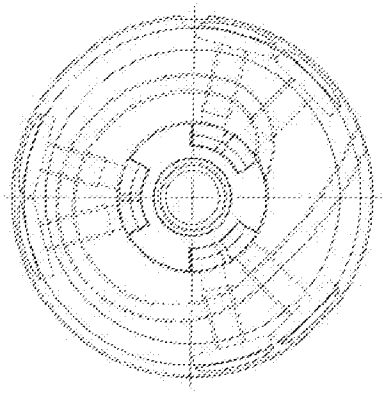
FIG. 47 is a bottom view of FIG. 45.
Figure 49:
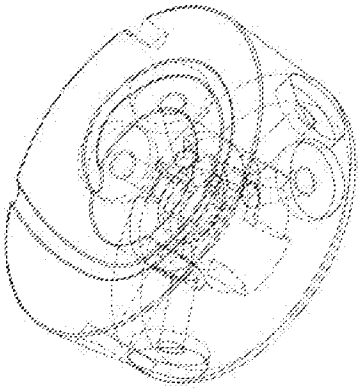
FIG. 49 is a perspective view of the inner wire guide 44 of FIG. 45.
Figure 46:
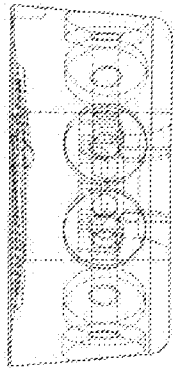
FIG. 46 is a side view of FIG. 45.
Figure 45:
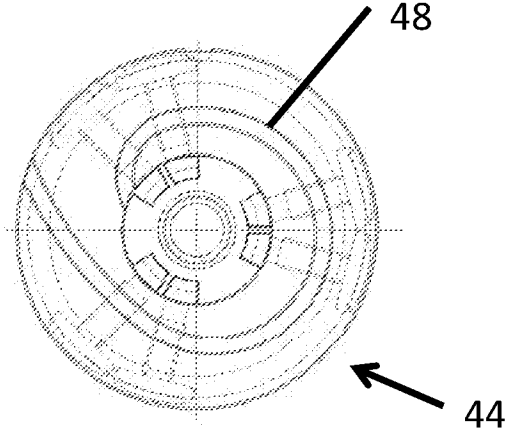
FIG. 45 is a top view of an embodiment of an inner wire guide 44.
Figure 48:
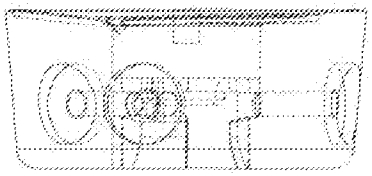
FIG. 48 is a section view of FIG. 45.
Figure 50:
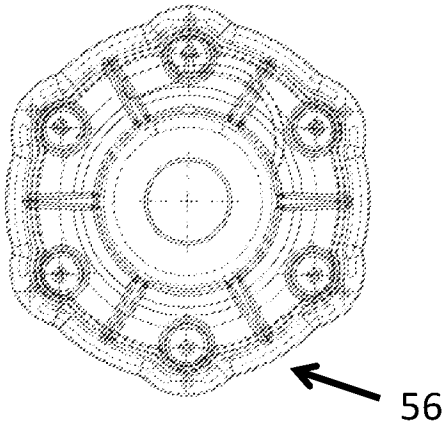
FIG. 50 is a top view of an embodiment of an outer housing 56.
Figure 51:
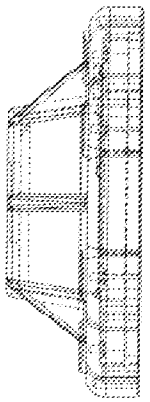
FIG. 51 is a side view of FIG. 50.
Figure 52:
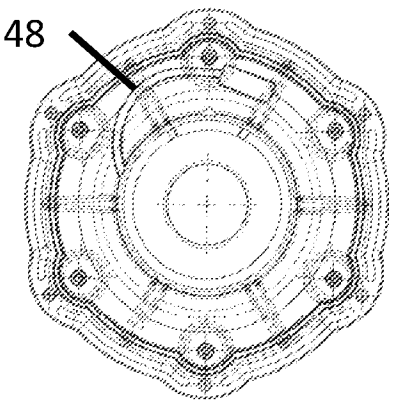
FIG. 52 is a bottom view of FIG. 50.
Figure 53:
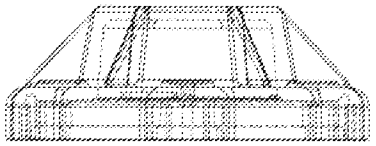
FIG. 53 is a section view of FIG. 50.
Figure 54:
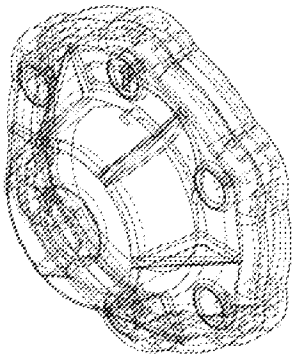
FIG. 54 is a perspective view of the outer housing 56 of FIG. 50.
Figure 56:
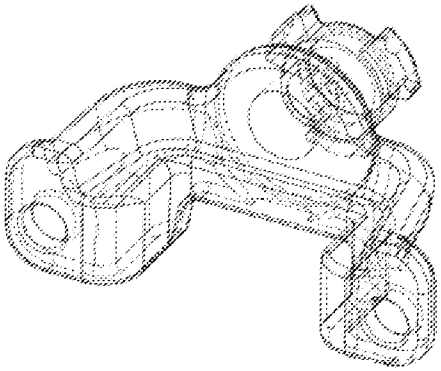
FIG. 56 is a perspective view of FIG. 55.
Figure 59:
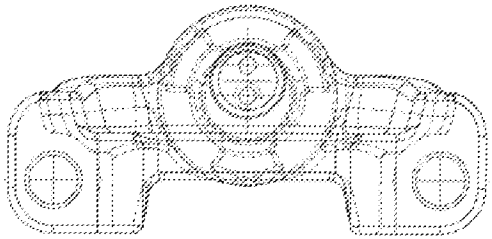
FIG. 59 is a bottom view of the locking nub 58 of FIG. 55.
Figure 58:
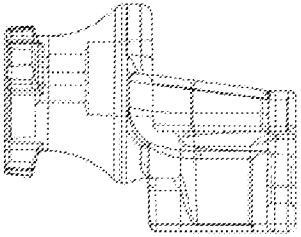
FIG. 58 is a side view of FIG. 55.
Figure 55:
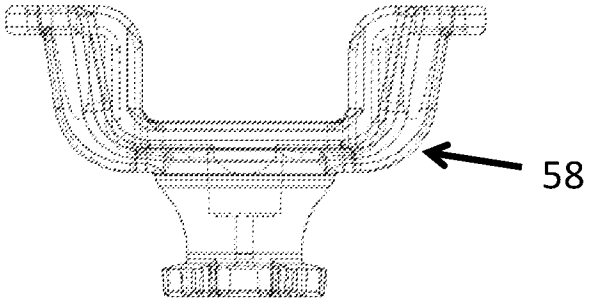
FIG. 55 is a side view of an embodiment of a locking nub 58.
Figure 57:
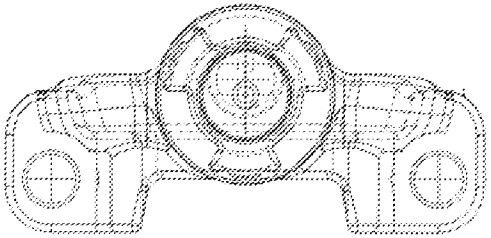
FIG. 57 is bottom view of FIG. 55.

In this way and as shown in FIGS. 2-3, the preferred embodiment of the tether sheath assembly is created by fitting four pieces together: the wire guide back 36, the inner wire guide 44, the center wire guide 42 and the outer housing 56. The top side of the wire guide back 36 contains the entire bottom channel 46. The remaining three pieces, when fit together form the top channel 48. When joined together, these four pieces form a tether sheath 60 shaped to hold and re-orient the tether as shown in FIGS. 33-35. By creating a tether sheath 60 in the shape shown in FIGS. 33-35, and locating it above a conventional spring spool retraction assembly, the preferred body mount 10 can enable extension and retraction of the hand-held device perpendicular to the rotation of the spool 28 (or parallel to the axis of rotation of the spool 28).

It is preferred that the elements that comprise the tether sheath 60 be made from materials having heat resistant, high strength and low friction qualities. For example, it is preferred to make the wire guide back 36, wire drop guide 38, inner wire guide 44, bottom housing, outer housing 56 and strap clamp 12 and from an amorphous thermoplastic polyetherimide (PEI) resin. An example of such a material is sold under the trademark Ultem® by Sabic Global Technologies. And to reduce friction even more, it is preferred to make the center wire guide 42 and wire spool 28 from a material sold under the trademark Delrin® AF, which is a combination of 10% to 25% oriented PTFE fluorocarbon fibers dispersed in Delrin acetal resin. Otherwise, the other elements disclosed herein are preferably made from strong rigid materials like titanium (e.g. center post 22), and stainless steel (e.g., locking nub 58). Those in the art, however, will recognize other materials having similar properties that could be substituted.

Figure 60:
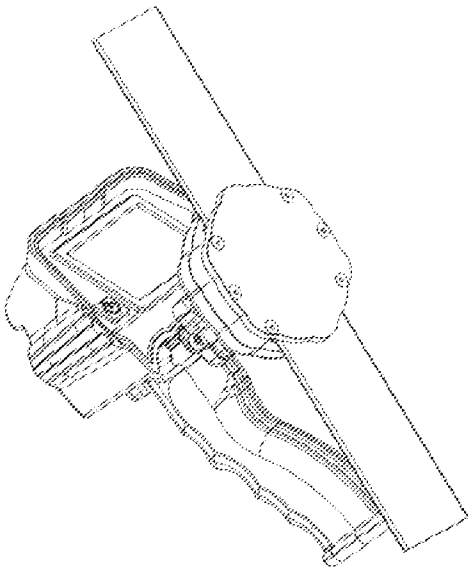
FIG. 60 is a rear perspective view of FIG. 1.

In operation, a user would preferably mount the device to a wearable belt or strap. This can be done by any number of ways known in the art. The preferred way, as shown in FIGS. 60-61, is by sandwiching a strap between the housing bottom 20 and a belt retainer 62. Once the body mount 10 is mounted to the strap, a user can wear the strap and connect a hand-held device to the locking nub 58. Once connected, the user can then extend the hand-held device away from the body mount 10 to use it in extended mode. Or, the user can leave it in the retracted position for hands-free use in the retracted mode. In this way, the present invention provides a significant improvement over the prior art of body mount tethering because it enable hands-free portable power, video and data transfer for public safety personnel and others operating in extreme environmental conditions.

While embodiments of the disclosure have been described in terms of various specific embodiments, those skilled in the art will recognize that the embodiments of the disclosure may be practiced with modifications within the spirit and scope of the claims.

What is claimed is:

1. A body mount and retractor apparatus for use in public safety applications, the apparatus comprising:

a housing and a tether, the housing comprising a retractor assembly for retracting the tether on a spool, the spool rotating about a first axis, the housing further comprising a tether sheath assembly, and the tether sheath assembly comprising an interior tube for slidably accepting the tether, a first end of the interior tube is oriented to accept the tether as it exits the spool, the second end of the interior tube is oriented in a direction parallel to the first axis, wherein at least part of the interior tube is formed by fitting a bottom channel to a top channel, the bottom channel located on a first piece and the top channel located on a second piece.

2. A body mount and retractor apparatus for use in public safety applications, the apparatus comprising:

a housing and a tether, the housing comprising a retractor assembly for retracting the tether on a spool, the spool rotating about a first axis, the housing further comprising a tether sheath assembly, and the tether sheath assembly comprising an interior tube for slidably accepting the tether, a first end of the interior tube is oriented to accept the tether as it exits the spool, the second end of the interior tube is oriented in a direction parallel to the first axis, the tether sheath making at least one full rotation about the first axis.

* * * * *